United States Patent [19]

Hollon et al.

[11] Patent Number: 4,682,910

[45] Date of Patent: Jul. 28, 1987

[54] MARKING SYSTEM

[76] Inventors: Edmund D. Hollon, 130 Frontier Ave.; Blake D. Hollon, 1941 Park Dr., both of Douglas, Wyo. 82633

[21] Appl. No.: 862,823

[22] Filed: May 13, 1986

[51] Int. Cl.[4] ..... E02B 7/40

[52] U.S. Cl. ..... 404/94; 404/93; 33/27.03

[58] Field of Search ..... 404/93-95; 118/305, 313, 315; 33/27.03, 27.01

[56] References Cited

U.S. PATENT DOCUMENTS

| | | | |
|---|---|---|---|
| 2,076,370 | 4/1937 | Hollingshed | 404/94 |
| 2,633,382 | 3/1953 | Dudley et al. | 404/94 X |
| 4,241,506 | 12/1980 | LeBlanc et al. | 33/27.03 |

FOREIGN PATENT DOCUMENTS

| | | | |
|---|---|---|---|
| 269584 | 10/1950 | Switzerland | 33/27.03 |
| 644653 | 8/1984 | Switzerland | 404/93 |

*Primary Examiner*—William F. Pate, III
*Assistant Examiner*—R. Chilcot
*Attorney, Agent, or Firm*—Hugh H. Drake

[57] ABSTRACT

A marking system indicates the location of lanes which are to be defined on a running track that has a given width and selected degree of curvature. A pivot is established at a fixed distance from the lanes to be marked. A boom assembly disposed laterally across the track carries a plurality of lane-marking devices individually spaced therealong. That assembly is supported for movement along the track. One end of the boom is propelled by a propulsion unit, and an alignment unit is coupled to the other end of the boom for enabling alignment movement relative to the pivot. A cable leads from the outer end of the boom over the inner end thereof and to the pivot for enabling alignment. Numerous detailed features contribute to an attainment of accuracy measured in fractions of an inch.

13 Claims, 10 Drawing Figures

MARKING SYSTEM

The present invention relates to a system for marking the location necessary for the establishment of lanes on a running track. More particularly, the invention pertains to a system which enables the location of such lanes on an arcuate portion thereof.

Of course, the competitive sport of running has evolved over many centuries. So have the rules which govern the competition in the different events. The typical running track is of oval configuration in overall shape, often surrounding an infield within which other events occur, including some which are categorized as belonging to other sporting events.

A number of the different running events require that the participant remain within a lane defined by visable markings which separate the different lanes from the inside to the outside of the oval. One popular lane width is forty-two inches. A standard width adopted by an international amateur federation is forty-eight inches. However, a still different width may be specified for a given installation. In any case, the rules may expect that the accuracy of such spacing will be within one-fourth of an inch. Failure of observance of such accuracy may lead to disqualification of the track for competitive events or cause a participant to lose credit for that which otherwise was a record-breaking performance.

The achievement of the necessary accuracy is difficult. The entire field of terrain over which the track is laid seldom, if ever, is flat and uniform. The prescribed accuracy, of less than one percent, can be achieved manually, but that approach is very time consuming and is subject to human error.

The machines which rely on the marking and actually apply the ultimate lane-defining material exhibit their own variations in tolerance, so that deviations tend to cumulate. Accordingly, it is very necessary that the initial marking system be as exact as possible.

While various lane-marking systems have been devised for use on vehicular highways, they are insufficient for the purpose at hand. In that field, a variation of at least a few inches can be acceptable, compared with the need in sporting events of what amounts to a one-fourth-inch accuracy. One need only to refer to applicants' U.S. Pat. No. 4,465,397 to observe further discussion about the fact that the establishement of running tracks presents unique problems that are not even present in the building of highways.

It is, accordingly, a general object of the present invention to provide a new and improved marking system for use with running tracks.

Another object of the present invention is to provide a new and improved marking system which enables accurate location of the lanes in a manner that allows simplicity of the apparatus required.

A further object of the present invention is to provide a new and improved system which is adaptable in varying degrees to minimize the amount of labor.

In accordance with one aspect of the present invention, a marking system indicates the location of lanes on a running track that has a predetermined width and a selected degree of curvature. Locating means positioned at a fixed distance from lanes to be marked on the running track cooperate with a boom assembly disposed laterally across the track, with that assembly carrying a plurality of lane-marking devices individually spaced successively along its length. The boom is supported for movement along the track. Propulsion means coupled to one end portion of the boom assembly propel that one end portion along the track, while aligning means coupled to the other end portion of the boom assembly enable aligning movement of the boom assembly relative to the locating means. Finally, alignment means couples both of the end portions of the boom assembly to the locating means. Other features of the invention contribute further to its efficacy.

The features of the present invention which are believed to be patentable are set forth with particularity in the appended claims. The organization and manner of operation of one specific embodiment of the invention, together with further objects and advantages thereof, may best be understood by reference to the following description taken in connection with the accompanying drawings, in the several figures of which like reference numerals identify like elements, and in which:

Figure 1:
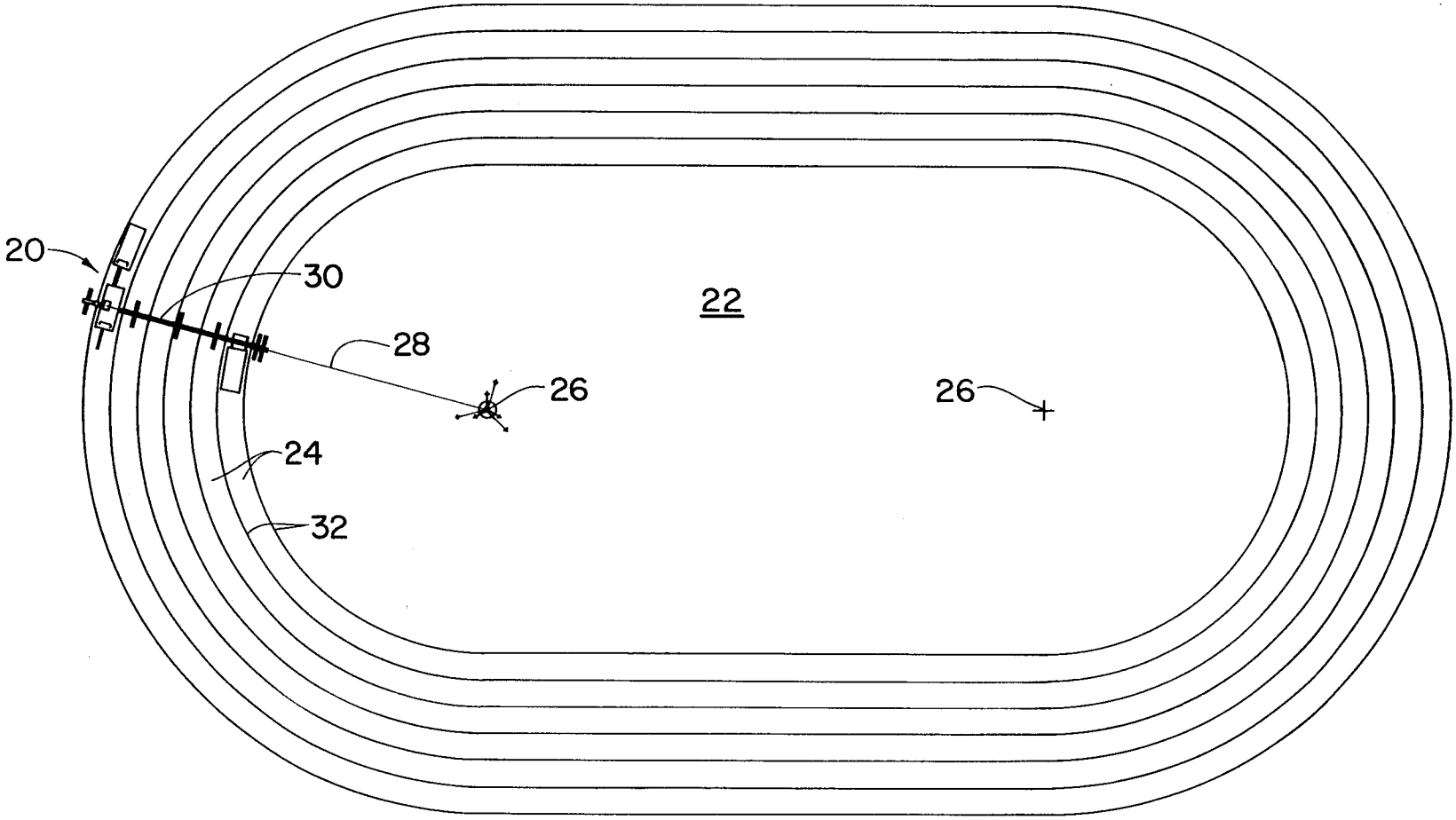
FIG. 1 is a plan view of a marking system embodied in accordance with the present invention in the environment of concern.

Turning first to FIG. 1 for an explanation of the environment, a running track 20 of general oval configuration circumscribes an infield 22. Track 20 is to be marked to divide its width as between a plurality of successive lanes 24 which, in this particular case and solely for purposes of illustration, are six in number. The surface for lanes 24 preferably, though not neccessarily, would have been formed in accordance with the approach described in the aforesaid U.S. Pat. No. 4,465,397.

Each end portion of track 20 is arcuate, so as to define a radius center 26. Projecting outwardly from a pivot point defined by center 26 is a flexible cable 28 which continues over and to the outer end portion of a boom assembly 30. As will be described in more detail, the purpose of boom assembly 30 is to emplace upon the upper surface of track 20 a succession of lines of what may be called pin stripes 32 which are to serve the purpose of guiding other apparatus, not herein described, which paints wider lane markers upon the surface of track 20.

Figure 2:
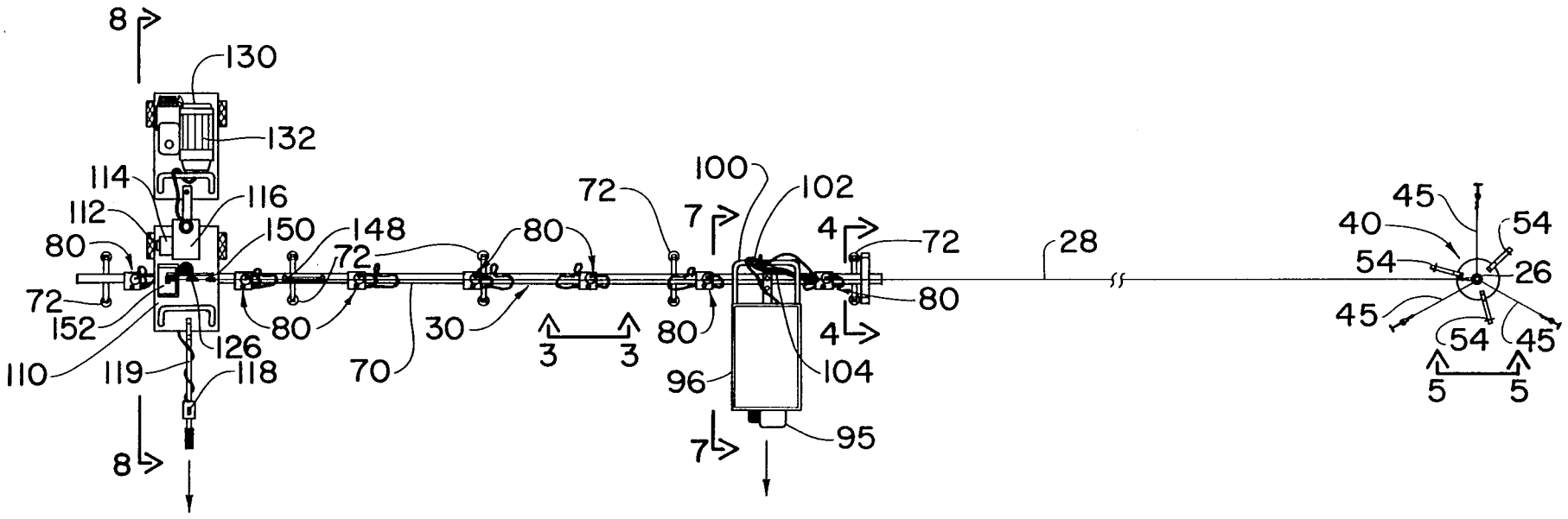
FIG. 2 is a more detailed and enlarged plan view of the marking apparatus itself.
Figure 5:
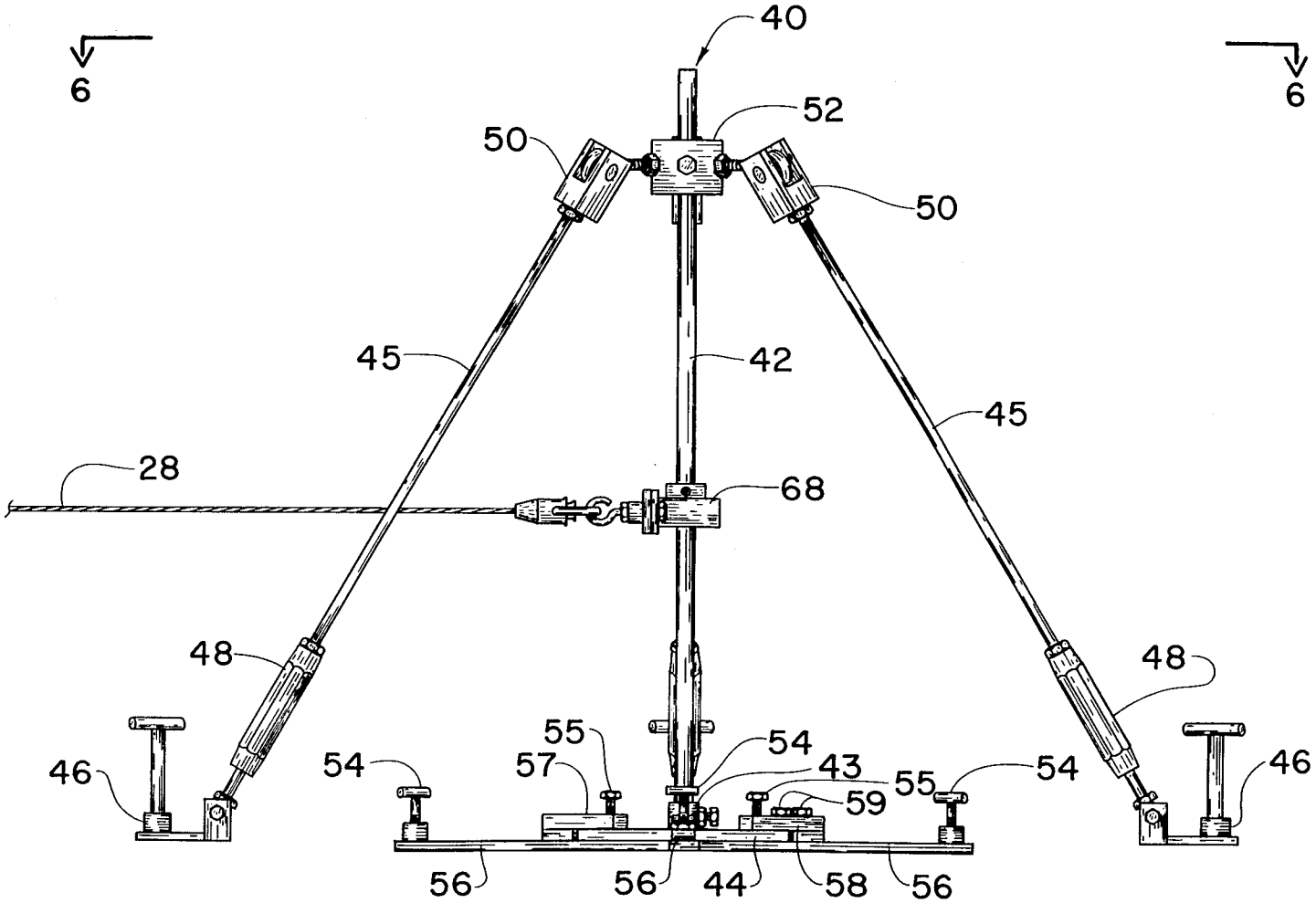
FIG. 5 is an enlarged fragmentary elevational view taken along the line 5—5 in FIG. 2.
Figure 6:
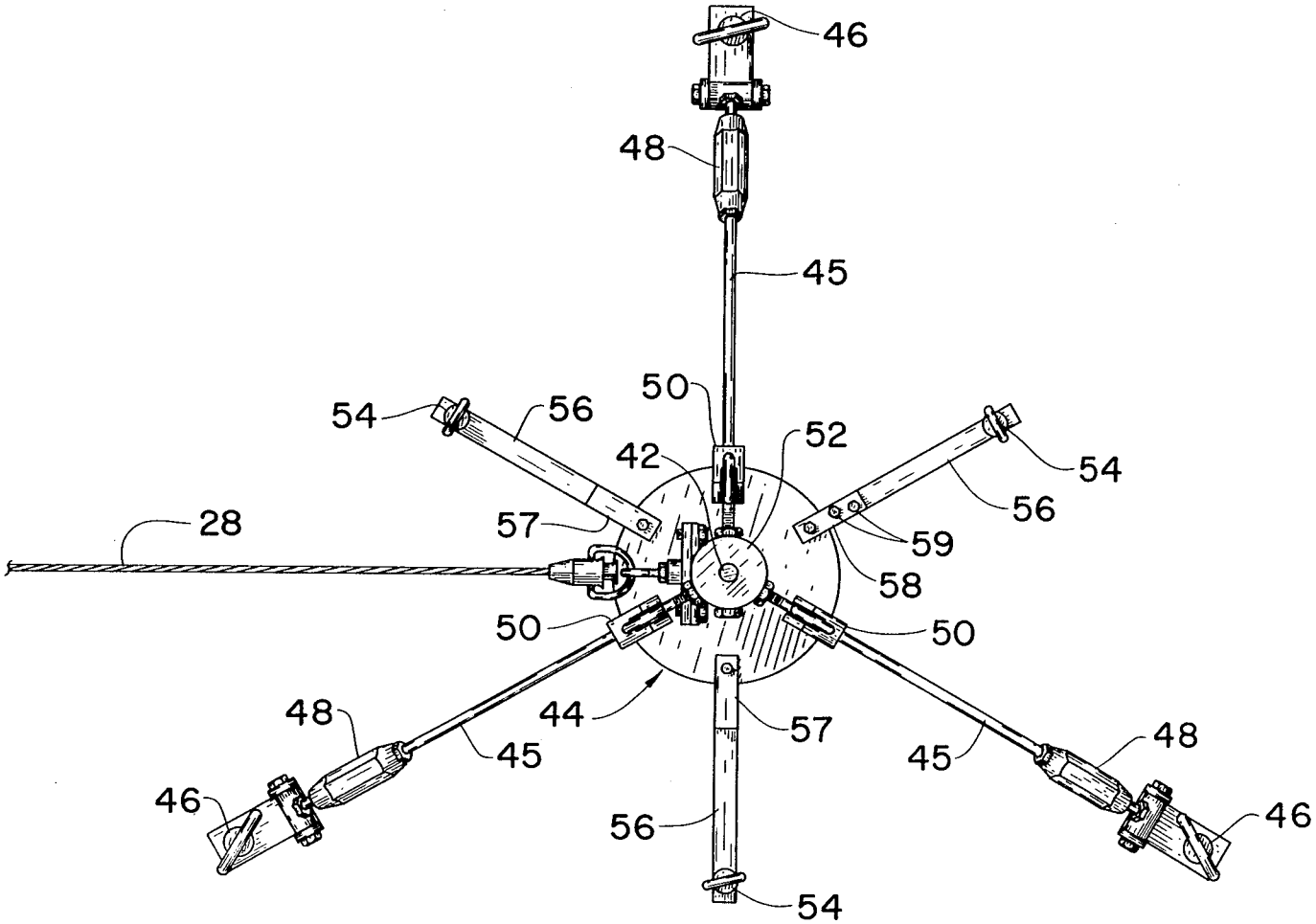
FIG. 6 is a fragmentary plan view taken along the line 6—6 in FIG. 5.

As best observed in FIGS. 2 and 5, cable 28 leads away from pivot 26 in alignment with that which is a locator 40. Locator 40 includes an upright post 42 (FIGS. 5 and 10) coupled by a collar 43 to a mounting plate 44 at its lower end portion and tied from a more upwardly-disposed portion to a tether arrangement which includes, in this case, three rods 45 circumferentially spaced. Rods 45 are secured by ground anchors 46 to the underlying substrate presented by the ground in infield 22 and individually coupled through turnbuckles 48 to pivotal mountings 50 in turn tied to a collar 52 secured to that higher position on post 42.

Figure 10:
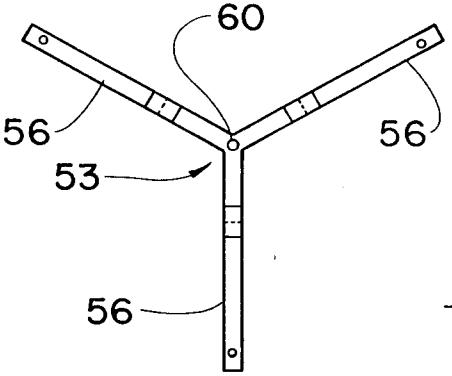
FIG. 10 is a plan view of a component assembly shown in FIG. 5.

As shown in FIGS. 5 and 10, plate 44 is mounted atop a Y-shaped base assembly 53 that has ground fasteners 54 located on the outer end portions of respective arms 56. Plate 44 is secured by bolts 55 through cleats or couplings 57 affixed to the respective ones of arms 56, with at least one of those cleats being bolted to a corresponding arm to allow assembly or removal of plate 44 as illustrated at 59.

A hole 60, at the junction of arms 56, accepts the bottom end of post 42. Couplings 54, therefore, permit plate 44 to be moved laterally, after all ground anchoring which may lead to position deviations, so as to insure that the bottom of post is located at the appropriate point.

Turnbuckles 48 enable post 42 to be plumbed into a truly vertical position, one other apparent necessity for ultimate accuracy to be achieved with the overall apparatus yet to be described in detail. Cable 28 is secured to an intermediate portion of post 42 in a manner to allow that end of cable 28 to rotate around the post as boom 30 is moved along the track. While that coupling assembly can be of any suitable form, it is here depicted as a pillow block 68.

In the illustrated arrangement, cable 28 must be reconnected to pillow block 68 before swinging through more than 120 degrees. This enables cable 28 to be secured at a height relative to boom assembly 30 that maintains horizontal orientation of cable 28. The latter orientation is essential for achieving accurate lane definition on curves. In an alternative, a modified locator may be used to allow continuous swinging movement of cable 28, provided that the plumb of post 42 is retained, its bottom end is accurately located exactly over the surveyed and selected pivot point and cable 28 is level and, thus, projects at a fixed angle to post 42.

Figure 4:
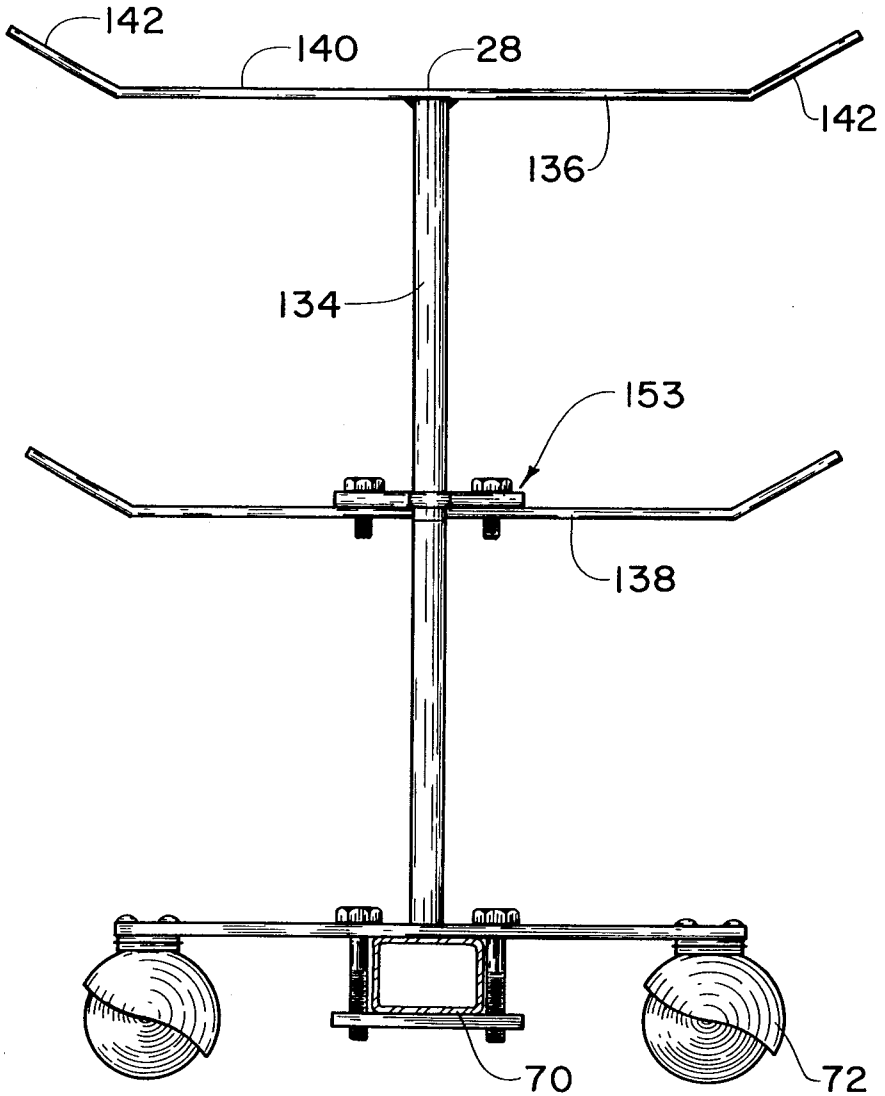
FIG. 4 is an enlarged fragmentary cross-sectional view taken along the line 4—4 in FIG. 2.
Figure 3:
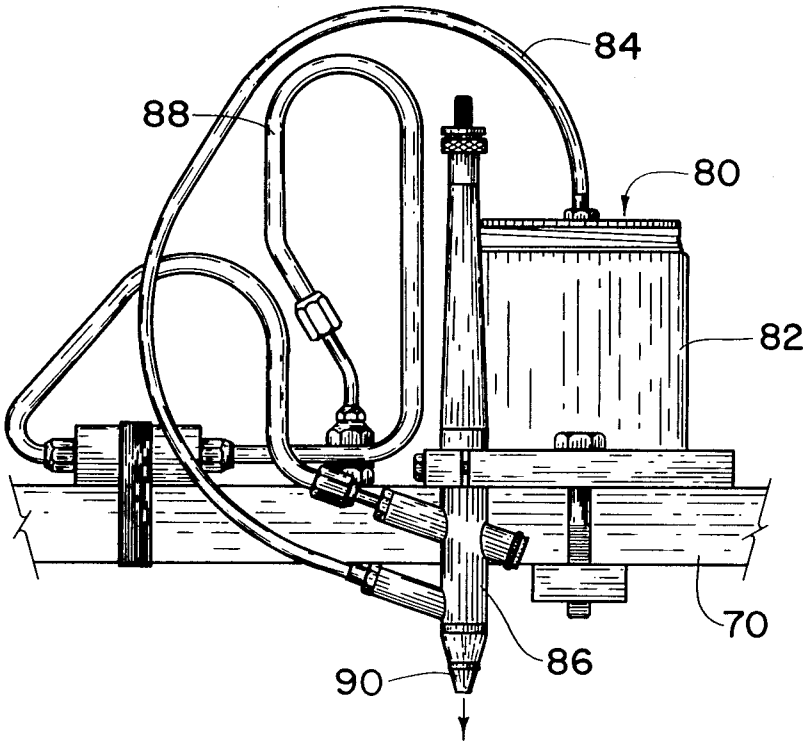
FIG. 3 is an enlarged fragmentary view taken along the line 3—3 in FIG. 2.

Individually spaced successively along a boom 70 are a plurality of support wheels 72 (FIG. 4) and also a plurality of what may otherwise be conventional paint sprayers 80. Each includes a canister 82 for containing the paint and is coupled to a hose 84 which leads to a nozzle assembly 86. Compressed air delivered by way of the interior of boom 70 is conveyed through a hose 88 also into nozzle assembly 86 for drawing the paint solution out of canister 82 and delivering it through a nozzle 90 in a pattern which in this case is extremely fine, applying to the surface of track 20 a pinstripe of approximately only one-eighth inch in width.

As indicated, the compressed air for supply through hose 88 comes from the interior of boom 70. To that end, a compressor 94, driven by an engine 95, is mounted on a free-wheeling dolly 96 secured to the inner end portion of boom 70. Compressor 94 builds up a compressed air supply in a tank 98 located on dolly 96. A handle 100 in this case enables an operator to manually move dolly 96 fowardly along the track. Of course, tank 98 is coupled into the interior of the boom, in this case through a valve assembly at 102 and accessable to the operator. Connected with that valve assembly is an exhaust hose 104 which allows immediate escape of the compressed air from within boom 70 in order to cause cessation of the paint supply. Necessarily, boom 70 is closed at its respective opposite ends.

At the outer end of boom 70 is a propulsion unit 110 mounted on wheels 112 driven through a reduction gear unit 114 from a variable-speed electric motor 116. A control switch 118 is mounted toward the forward end of arm 119, and a controller 120 which serves as a reversing switch, is situated atop motor 116.

Propulsion unit 110 urges the outer end portion of boom 70 in a forward direction. This is accomplished by the suspension within unit 110 of a vertical rod 126 which is positioned to the rear of boom 70 so as just to nudge it forwardly. That is, there preferably is no fixed connection. It appears that better accuracy of the actual lane-position indicating is achieved by what may be termed a "loose" interconnection to the motive power.

Of course, energy is required for the motive drive system. In this case, a trailer 130 is towed behind unit 110 and carries an engine driven generator 132. Of course, generator 132 could be located elsewhere or even made a part of one of the other assemblies that roll with boom 70. In principle, generator 132 also could be used to supply energy to a motor that powered compressor 94.

The innermost dolly 96 includes an upright pole 134 laterally disposed across the top of which is a cable guide 136. Another cable guide 138 also is provided for alternative use if the terrain involved to the infield undulates more than usual. Guide 136 includes a horizontal fore-and-aft strap 140 with somewhat upturned respective ends 142. The other guide is similar. Moreover, pole 134 may include separate upper and lower portions detachable at a fixture 153.

In use, cable 28 is intended to ride atop strap 140 and, in this specific embodiment, it is the task of the operator following behind unit 96 to exert on handlebar 100 the force necessary to ensure that cable 28 is centered as closely as possible on strap 140. When that is done, boom 70 is so aligned on the arc relative to pivot 26 that the tolerances required in the pinstriping are maintained.

While automatic sensing of cable position, and separate powered drive for dolly 96 could be incorporated, it appears that the most simple use of guide 136 or 138, as visually observed by one operator, is a key to maintaining the necessary accuracy of the actual radial location of the ultimate lanes with minimal complexity and maximum economy.

Figure 9:
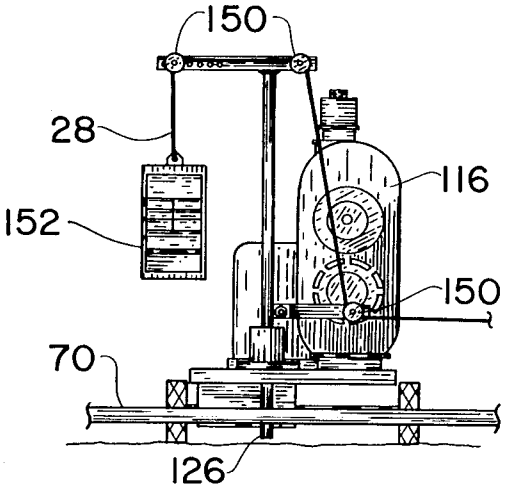
FIG. 9 is a fragmentary elevational view taken along the line 9—9 in FIG. 2, with some components deleted or only schematically indicated.
Figure 8:
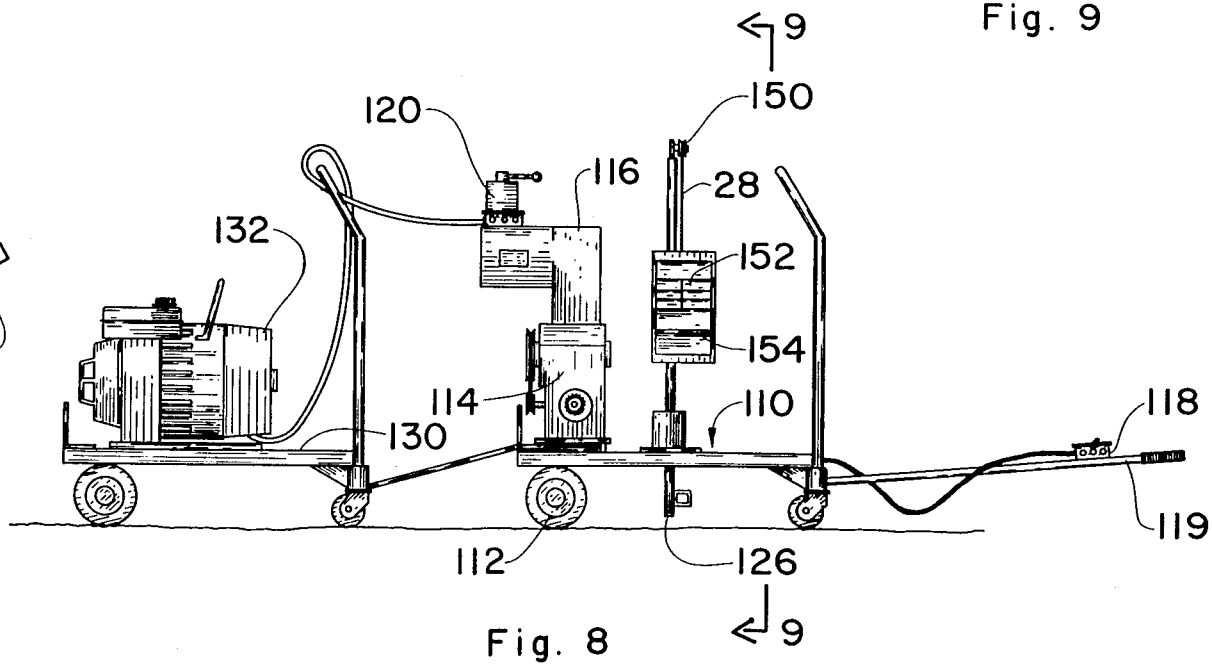
FIG. 8 is an enlarged fragmentary side elevational view, taken along the line 8—8 in FIG. 2, of another component assembly shown in FIG. 2.
Figure 7:
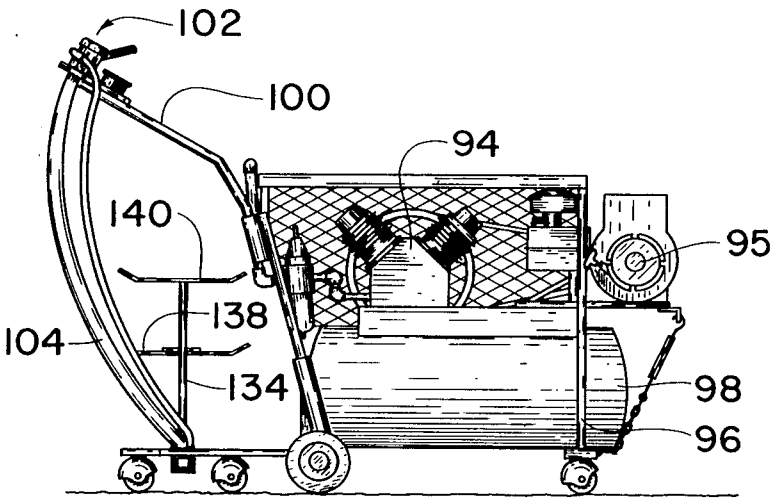
FIG. 7 is an enlarged fragmentary side elevational view, taken along the line 7—7 in FIG. 2, showing a component assembly of FIG. 2.

However, another key to proper ultimate performance appears to reside in the tensioning imposed upon cable 28. To this end, the outer end of cable 28 leads through a clamp 148 and turns up and goes over rollers as at 150 to an adjustable weight load 152 connected to the outer end of cable 28 (see FIG. 9). In this case, a selected number of lead weights are disposed to adjust the tension on the system. Not only does the selection of the amount of tension imposed on cable 28 keep it taut, but that degree of weight in load 152 may need to be varied in order to accomodate different environments, such as are afforded by variations in track surfaces or terrain.

In operation, a worker walking beside arm 119 manipulates that arm to maintain constant the height of weight 152 relative to a mark at 154. That is, the weight causes an even tug to be exerted on clamp 148. In turn, that tug maintains boom 70 in a linear alignment.

It may be observed that numerous variations may be made or adapted as alternatives. The manner of adjustment of the plumb of post 42 undoubtedly could be accomplished in other ways. In the preferred embodiment, blocks of forty-pound lead weights were used in stack load 152 to adjust the tug on cable 28 which was composed of a plurality of seven-strand stainless steel wires for a total of forty-nine stainless steel strands; different cables may, of course, require different weight loads for best performance. Clearly, the number of lanes involved will vary tension requirements.

The determination as to which end of boom 70 is driven by a motive power source and which end is adjusted may be only one of choice, although it appears that the illustrated preferred embodiment solves alignment problems in absolutely the best manner. Naturally, the ultimate source of power for applying traction and compressive power could be towed anywhere or might even be somewhat separate.

Compressed air could be supplied along the boom to the different marking devices by separate hosing, control of the delivering of the pin-striping material could be entirely by individual solenoids or the like located at the different successively spaced positions and automatic sensors of cable position located in association with cable guide 136 (or 138) could be adapted to maintain the necessary centering as between the pivot point and both ends of the boom, without destroying the principle of the approach. The preferred approach does not go that far for the reason that it does not appear to be economically feasible in the environment as considered in relation to likely frequency of use.

FIG. 1 illustrates truly circular end portions of the oval track. Some tracks have that which is called the "broken-back" layout. Adaptation to that approach may be made with a change in the pivot point, as at 26, to be used for different portions of the curving end portion.

While a particular embodiment of the invention has been shown and described, and other alternatives and variations have been disclosed, it will be obvious to those skilled in the art that changes and modifications may be made without departing from the invention in its broader aspects. Therefore, the aim in the appended claims is to cover all such changes and modifications as fall within the true spirit and scope of that which is patentable.

We claim:

1. A marking system for indicating the location of successively-spaced lanes on a running track having a predetermined width and a selected degree of curvature, said system comprising:

locating means positioned at a pivot point radially inward at a fixed distance from the innermost ones of said lanes to be marked on said running track;

an elongated boom assembly disposed laterally across said track, said assembly carrying a plurality of lane-marking devices individually spaced successively along its length in correspondence with the respective positions of said lanes;

means supporting said boom assembly for a movement along said track;

propulsion means coupled to one end portion of said boom assembly for propelling said one end portion along said track and around said pivot point;

aligning means associated with the other end portion of said boom assembly for enabling aligning movement of said other end portion of said boom assembly relative to said locating means to maintain said boom aligned lengthwise on a radius defined between the outermost end of said boom assembly and said pivot point;

and elongated alignment means for coupling one of said end portions to said locating means while enabling radially aligning movement of said other end portion.

2. A system as defined in claim 1 in which said locating means further comprises:

an upright post having a lower end;

a mount fixably securable to an underlying substrate and coupled to the lower end portion of said post;

a tether coupled at one end to another portion of said post above said mount and at its other end fixably securable to said substrate;

means for coupling one end of said alignment means to said post for swinging movement therearound;

and means included in one of said mount and said tether for adjusting said post to a plumb orientation.

3. A system as defined in claim 2 in which said mount includes a centering assembly for adjusting the lateral position of the lower end of said post relative to the upper end of said post.

4. A system as defined in claim 1 in which said lane-marking devices operate in response to compressed air, a source of compressed air is included in association with said boom assembly, said boom assembly includes means for conveying said compressed air to said devices and said system includes means for controlling the flow of said air to said devices.

5. A system as defined in claim 4 in which said source is located in said aligning means.

6. A system as defined in claim 5 in which a power supply is coupled to said assembly for movement along with said propulsion means.

7. A system as defined in claim 1 in which said propulsion means is coupled to the end portion of said assembly farthest from said locating means.

8. A system as defined in claim 1 in which said aligning means includes a sensor element responsive to orientation of said alignment means for providing a signal to enable said aligning movement.

9. A system as defined in claim 1 in which said alignment means is a flexible cable which leads from the end portion of said boom farthest from said locating means over the other end portion of said assembly and to said locating means.

10. A system as defined in claim 9 which includes means for selectively adjusting the tension in said cable and impose an outward tug on the outer end portion of said boom.

11. A system as defined in claim 10 in which said adjusting means is situated on said propulsion means.

12. A system as defined in claim 1 in which said propulsion means only nudges said one end portion of said boom assembly in propelling movement thereof.

13. A system as defined in claim 2 in which said alignment means is maintained in horizontal orientation relative to said substrate.

* * * * *